US005869920A

United States Patent [19]

Kavanagh

[11] Patent Number: 5,869,920

[45] Date of Patent: Feb. 9, 1999

[54] LIGHT SOURCE IN THE FORM OF A SEALED BEAM ARC LAMP INCLUDING THREE REFLECTIVE SURFACES

[75] Inventor: Martin Kavanagh, Lancashire, England

[73] Assignee: Digital Projection Limited, London, England

[21] Appl. No.: 750,212

[22] PCT Filed: May 10, 1995

[86] PCT No.: PCT/GB95/01064

§ 371 Date: Feb. 24, 1997

§ 102(e) Date: Feb. 24, 1997

[87] PCT Pub. No.: WO95/33280

PCT Pub. Date: Dec. 7, 1995

[30] Foreign Application Priority Data

May 31, 1994 [GB] United Kingdom ..... 9410872.7

[51] Int. Cl.[6] ..... H01J 5/16

[52] U.S. Cl. ..... 313/113; 313/114; 313/634

[58] Field of Search ..... 313/113, 114, 313/634; 362/296, 341

[56] References Cited

U.S. PATENT DOCUMENTS

| | | | |
|---|---|---|---|
| 3,805,052 | 4/1974 | Rambauske | 240/41.35 C |
| 4,050,775 | 9/1977 | Scholten | 350/200 |
| 5,272,570 | 12/1993 | Yoshida, et al. | 359/853 |

FOREIGN PATENT DOCUMENTS

| | | | |
|---|---|---|---|
| 0409554 A2 | 1/1991 | European Pat. Off. | G02B 5/28 |
| 2040636 | 1/1971 | France | F27B 17/00 |
| 2079435 A | 1/1982 | United Kingdom | F21V 7/09 |
| 93/26034 | 12/1993 | WIPO | H01J 61/52 |

*Primary Examiner*—Vip Patel

*Attorney, Agent, or Firm*—Schwegman, Lundberg, Woessner & Kluth, P.A.

[57] ABSTRACT

A light source suitable for use in a projection system is described. The light source is in a form of an arc lamp including an arc gap defined between an anode and a cathode. The arc gap is positioned at the focal point of a parabolic reflector which is truncated at its focal plane. A spherical reflector oppositely directed to the parabolic reflector and concentric with the focal point of the parabolic reflector is arranged so as to direct light from the arc which has not been intercepted by the parabolic reflector back into the arc gap.

9 Claims, 4 Drawing Sheets

LIGHT SOURCE IN THE FORM OF A SEALED BEAM ARC LAMP INCLUDING THREE REFLECTIVE SURFACES

BACKGROUND OF THE INVENTION

1. Field of the Invention

This invention relates to light sources. The invention has particular although not exclusive relevance to light sources for use in a projection system.

One form of projection system includes one or more spatial light modulators, each modulator being controllable so as to modulate an incident light beam. Each spatial light modulator is controlled by signals from an input video signal, and may be used to modulate light of a different colour, the coloured spatially modulated light beams then being combined to form a beam which is projected onto a projection screen.

2. Description of Related Art

Spatial light modulators may take various forms. One example is a liquid crystal light modulator as for example described in EP 401912. Another example is a tiltable mirror device as for example disclosed in U.S. Pat. No. 4,856,863. Such tiltable mirror devices comprise an array of mirrored elements, each element being arranged to be electrostatically deflectable between an "on" position in which light is reflected from the element onto a projection screen, and an "off" position in which the light is directed towards a beam dump dependent on address signals applied to the array. Thus a spatially modulated beam is produced comprising "white" areas corresponding to light from the "on" elements and "black" areas corresponding to light from the "off" elements. In practice greyscales are produced by temporal modulation.

In order to illuminate spatial light modulators, it is necessary to use a high intensity light source in order to provide a substantially uniform light beam. It is also necessary for the overall dimension of the projection system, and thus the light source to be relatively compact.

ILC Technology Inc of California, USA manufacture a compact, high intensity light source which may be used for projection systems incorporating a number of spatial light modulators. This light source comprises a compact xenon arc lamp arranged to operate with an input power supply of one kilowatt to produce a 5 cm diameter output beam. Such a light source, however, suffers the disadvantage that much of the light beam does not lie within the visible spectrum. Furthermore there is a limit to the amount of input power which may be supplied to the device due to problems of overheating.

In our copending International Patent Application WO 93/26034, there is described an arc lamp suitable for use as a high intensity light source in a projection system incorporating a number of spatial light modulators. The contents of WO 93/26034 are incorporated herein by reference. In the arc lamp described in WO 93/26034, a parabolic reflector is arranged to reflect the light produced by the arc into a directional light beam. Secondary reflection means are arranged to redirect part of the reflected beam to compensate for regions of the beam which are obscured by one of the electrodes of the arc lamp. Various heat sinks are provided within the light source so as to dissipate heat generated by the electrodes which define the arc.

The arc lamp described in WO 93/26034 will now be briefly described with reference to FIG. 1 which is a schematic, partially sectioned side view of the arc lamp described in WO 93/26034.

Referring to FIG. 1, the arc lamp comprises a cathode 101 and an anode 103 in a xenon atmosphere enclosed in an enclosure defined by a parabolic reflector 105 and a light emitting sapphire window 107 formed in the shape of a lens. The cathode 101 is supported by thin metallic supports 109, and is connected to a DC voltage supply (not shown). The anode 103 is connected to a battery via a conductive path through a mounting including a heat sink 113.

In use of the lamp, an arc is struck between the anode 103 and cathode 101. As the arc is arranged to be at the focal point of the parabolic reflector 105, light from the arc will be reflected by the parabola to form a substantially parallel beam directed out of the enclosure through the sapphire window 107. The light source is provided with an outer conical reflector 115, which is arranged to deflect light at the periphery of the beam towards the central portion of the enclosure to be reflected by an inner conical reflector 117 whose reflective surface is parallel to that of the outer reflector. The outer conical reflector 117 directs the light out of the window 107, thus compensating the central part of the output beam which is obscured by the presence of the cathode 101.

Heat dissipation from the lamp is improved by the presence of cooling fins 119 formed on the cathode 101. Cooling fins 121 are also formed on the heat sink 113.

A magnet 123, which may be a permanent magnet or an electro-magnet, is arranged in the anode mounting 113 so as to provide an axial magnetic field in the direction between the anode 103 and cathode 101. This magnetic field acts as a focusing field, reducing the diameter of the arc and thus reducing the divergence of the output beam. Inserts 125 and 127 of a soft magnetic material may be used to concentrate the magnetic field produced by the magnet 123.

It will be seen that this prior art light source, suffers the disadvantage that the output beam has a characteristic divergence and efficiency which is related to the size of the arc and to the focal length of the parabolic reflector 105. Thus the divergence is related to the size of the lamp and in order to reduce the divergence or increase the efficiency of the output beam, the lamp must be made larger.

It is an object of the present invention to provide a light source comprising an arc lamp which may have lower divergence and higher efficiency than have previously been possible, without the necessity of increasing the size of the lamp.

SUMMARY OF THE INVENTION

According to the present invention there is provided a light source comprising an arc lamp including an anode and a cathode arranged to provide an arc gap at the focal point of a conic reflector, and further reflective means arranged to reflect part of the light emitted by the arc gap in directions which do intersect the conic reflector back into the arc gap.

Thus by a light source in accordance with the invention, peripheral light produced by the arc gap is directed back into the arc gap, reducing the divergence of the output beam, and increasing the temperature and, hence the efficiency, of the arc.

The conic reflector is preferably a parabolic reflector.

BRIEF DESCRIPTION OF THE DRAWINGS

One embodiment of a light source in accordance with the invention will now be described by way of example only with reference to the accompanying drawings in which.

DETAILED DESCRIPTION OF THE INVENTION

Figure 1:
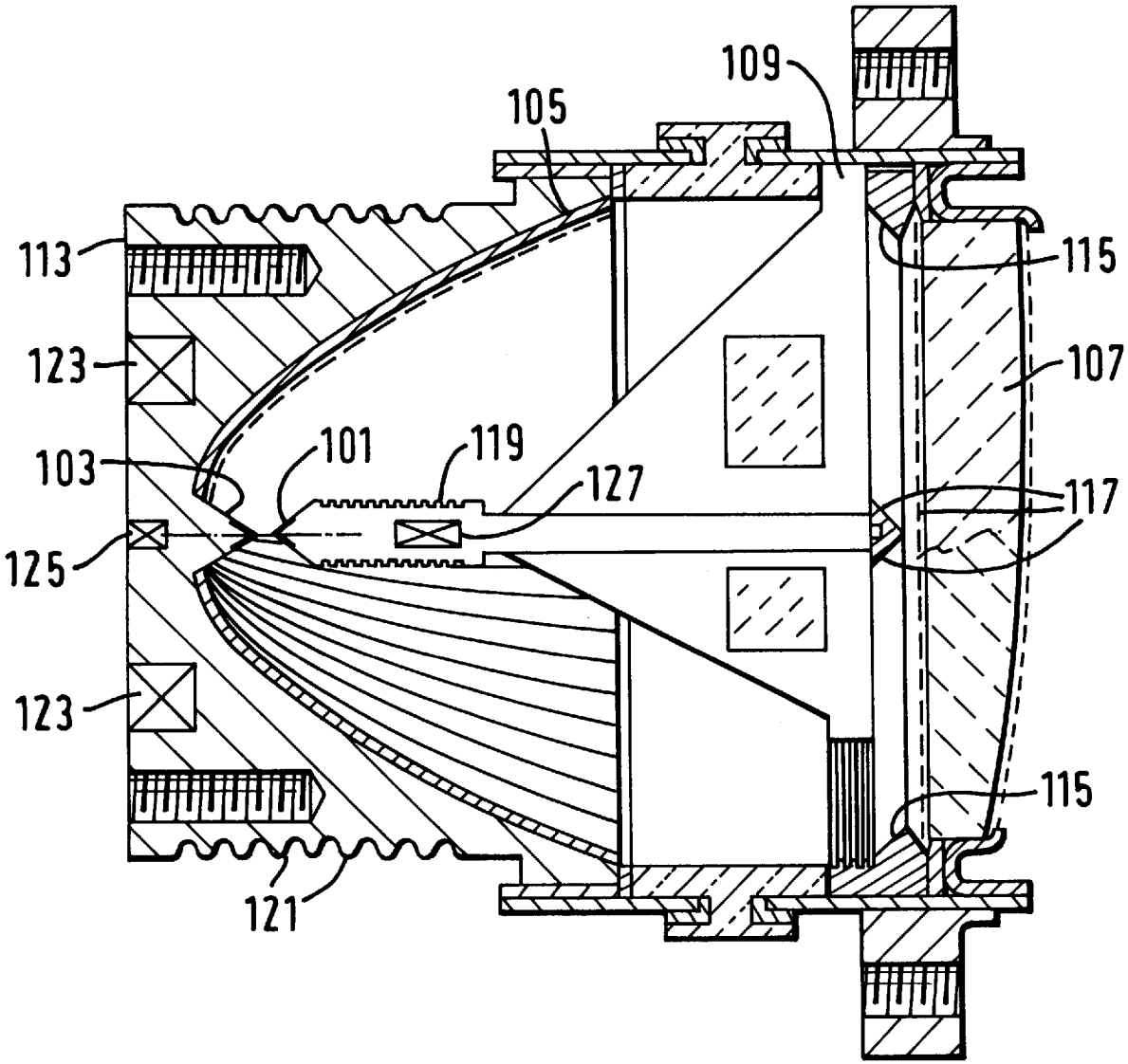
FIG. 1 (PRIOR ART)
FIG. 1 is a schematic, partially sectioned side view of a prior art light source as has already been described herebefore.
Figure 2:
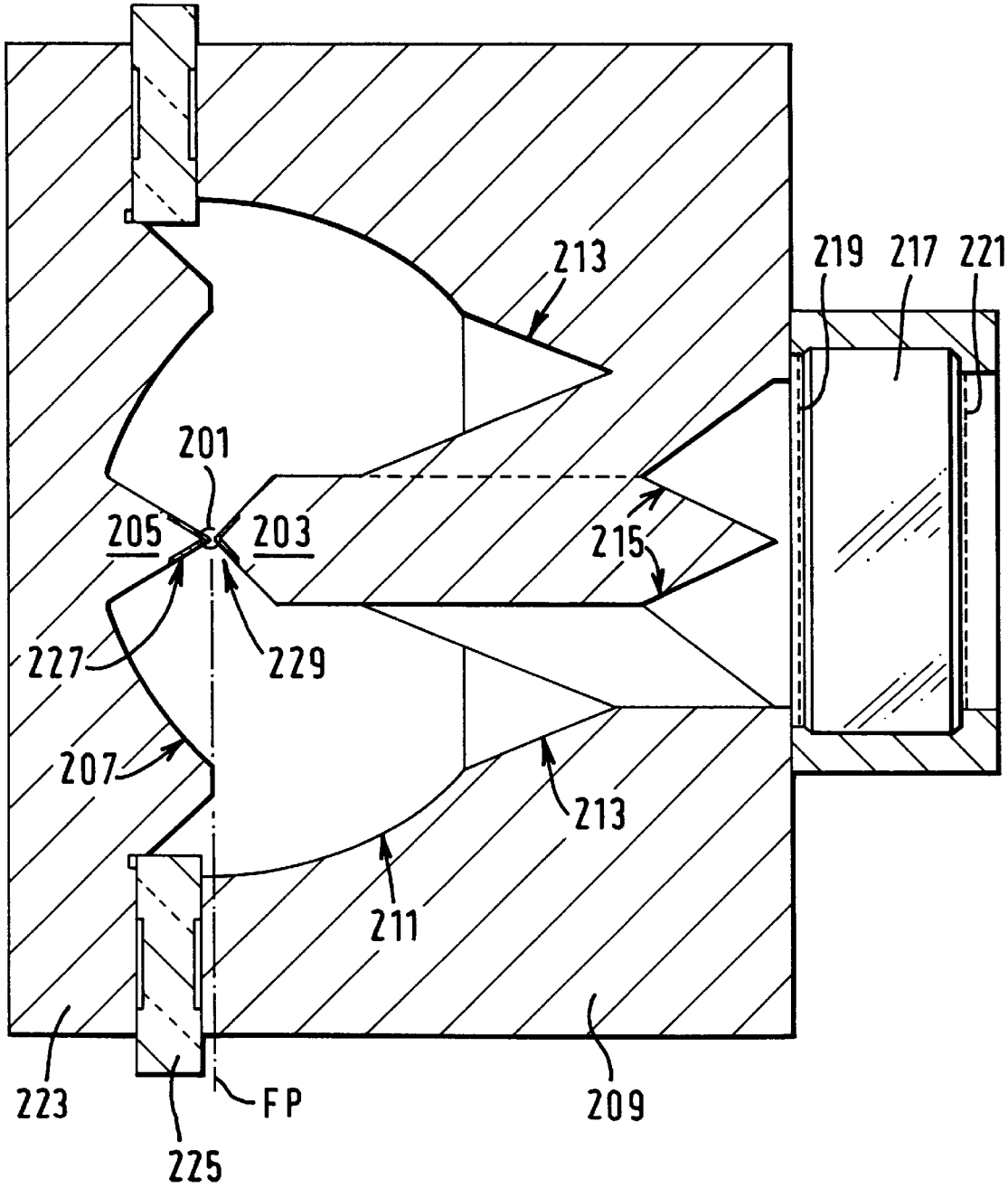
FIG. 2 is a schematic, partially sectioned side view of a light source in accordance with the invention.

Referring now to FIG. 2, the light source in accordance with the invention is an adaptation of the light source described in relation to FIG. 1. However, FIG. 2 is simplified in relation to FIG. 1 for the sake of clarity.

In the light source shown in FIG. 2, an arc gap 201 is defined between a cathode 203 and an anode 205, the arc gap being positioned at the focal point of a first parabolic concave reflector 207 which is truncated at its focal plane FP. The arc gap is contained in a xenon containing atmosphere enclosed in a housing partly defined by the parabolic reflector 207 and partly by a metallic block 209 whose inner surface is machined to provide both a second spherical reflector 211 and a third conical reflector 213. The spherical reflector 211 and conical reflector 213 are both oppositely directed to the parabolic reflector 207 and are both concentric with the focus of the parabolic reflector 207. A further central conical reflector 215, whose reflective surface is parallel to that of the conical reflector 213, is also provided.

As in the prior art arrangement the lamp is sealed by means of a sapphire window 217 formed as a focusing lens. The window 217 may carry on both its inner and outer faces infra-red reflective coatings 219, 221 whose functions will be described in more detail hereafter.

The anode 205 is mounted in a heat sink 223 which is secured to the metallic block 209 by a ceramic spacer 225.

The light source also includes other features of the arrangement shown in FIG. 1 such as a magnetic focusing arrangement, and cooling fins. These features have, however, been omitted from FIG. 2 for the sake of clarity.

Figure 3:
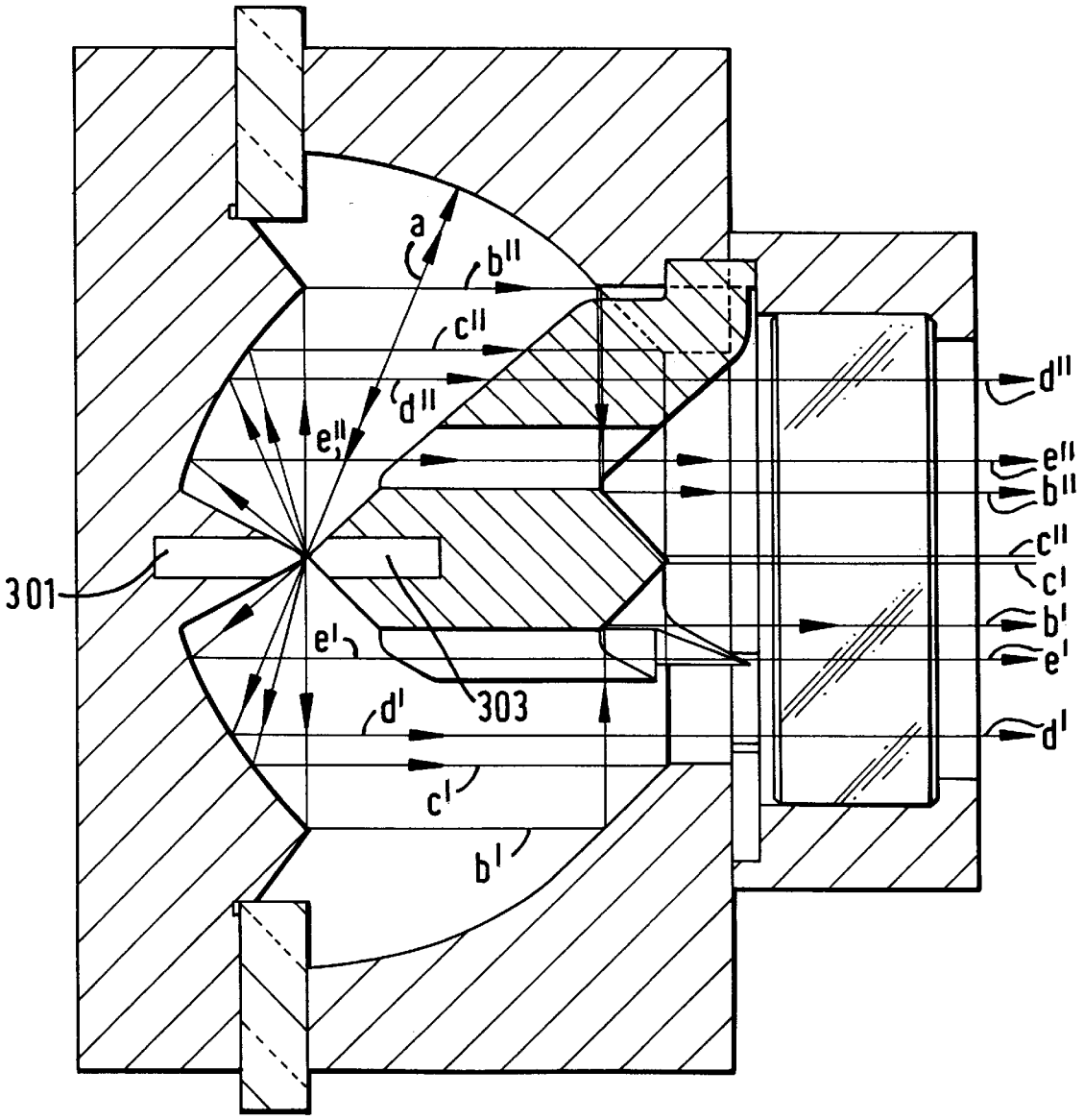
FIG. 3 is a side view equivalent to the view of FIG. 2 showing a number of light paths within the light source.

Referring now also to FIG. 3, as the parabolic reflector 207 does not extend beyond its focal plane FP, when an arc is struck between the electrodes 203, 205 any light emitted forward of the focal plane FP will be reflected by the spherical reflector 211 back to the arc gap 201. An example of this is shown as ray a in FIG. 3. Furthermore, the reflective coatings 219, 221 carried by the window 217 are designed to reflect high energy infra-red radiation from the arc back to the arc gap 201. This reflected light will be absorbed in the arc plasma which will act as a black body. The reflected light from the reflector 211 and the coatings 219, 221 will increase the plasma temperature considerably, and hence the radiation efficiency of the arc as the majority of energy returned to the plasma will be re-radiated and reflected by the parabolic reflector 207 through the window 217 and out of the lamp. The outermost beam, indicated in FIG. 3 by beams b' and b" transmitted forwardly by the parabolic reflector 207 will be reflected by the conical reflector 213 on to the outer edge of the conical reflector 215 for forward transmission through the window 217. The beams shown as c' and c" in FIG. 3 represent the limit of the beam reflected by the conical reflector 213 onto the innermost edge of the conical reflector 215.

Beams d' and d" in FIG. 3 represent beams which are reflected directly by the parabolic reflector 207 out through the window 217, these beams thus representing the outer limit of the output beam produced by the lamp. Light between d' and d", such as beams e' and e" in FIG. 3, will also be reflected directly out of the window 217 by the parabolic reflector 207.

Thus, it can be seen that the combination of the long focal length parabolic reflector 207 and the spherical reflector 211 enable a greater light collection, leading to higher arc efficiency and lower beam divergence than has previously been possible. It is found that in a light source in accordance with the invention, divergence of the output beam is roughly halved. As the maximum diameter of the output beam is reduced compared to prior art arrangements, the more compact beam enables a smaller window 217 to be used. In view of the use of sapphire as the window 217, and the necessary machining to form a lens, this leads to a considerable cost reduction. It is also found that the overall dimension of the light source can be reduced such that the length of the lamp is around 70% of prior art light sources.

It is particularly convenient for the anode holder and parabolic reflector 207 to be both fabricated from a single block of metal, this also forming part of the housing for the light source. Likewise it is convenient for the spherical surface 211 and conical surface 213 also to be formed from the same piece of metal, this forming a further part of the housing. It will however be appreciated that the various components may be formed separately and assembled together. With regard to the anode and cathode these will generally have tungsten surfaces at their tips in order to withstand the high temperatures reached by the arc. This may be achieved by the use of conical tungsten tips 227, 229 as indicated in FIG. 2 or by tungsten inserts as 301, 303 as indicated in FIG. 3.

Figure 4:
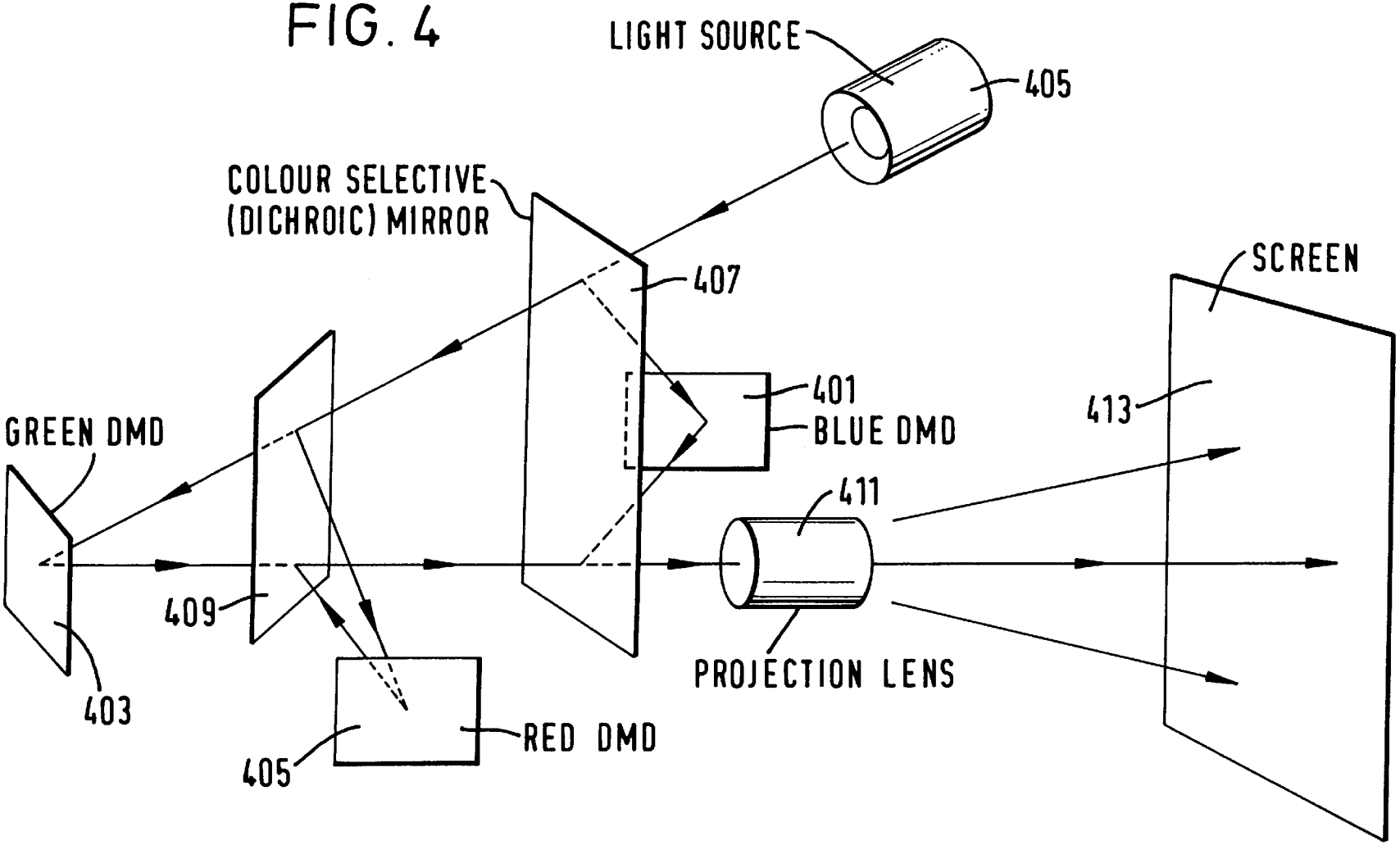
FIG. 4 is an overview of a light source in accordance with an embodiment of the invention incorporated in a projection system.

Turning now to FIG. 4, this figure illustrates the use of a light source in accordance with an embodiment of the invention in a projection system incorporating three deformable mirror devices 401, 402, 403, each device being effective to produce a spatially modulated light beam of a different primary colour. A light source 405 in accordance with the invention is arranged to generate light along an incident light path onto and through a pair of dichroic mirrors 407, 409. The first mirror 407 is arranged to transmit red and green light, and reflect blue light onto the first deformable mirror device 401. The second dichroic mirror 409 is arranged to transmit green light onto the second deformable mirror device 403 and reflect red light onto a third deformable mirror device 405.

Dependent on address signals applied to the three deformable mirror devices 401, 403, 405, each device 401, 403, 405 is effective to reflect a spatially modulated beam back along the optical axis of a projection lens 411, the remaining light being reflected towards a beam dump [not shown].

The dichroic mirrors 407, 409 also cross the optical axis of the projection lens so as to combine the spatially modulated blue, green and red light reflected from the deformable mirror devices 401, 403, 405. Thus a spatially modulated colour image is directed through the projection lens 411 onto a screen 413, thereby producing a colour display representative of the address signals supplied to the deformable mirror devices 401, 403, 405.

Thus it can be seen that a light source in accordance with the invention has particular applicability in such a projection system as the light source is capable of providing a substantially uniform low-divergence light beam. Furthermore the light source is particularly efficient as light which is reflected forward of the focal plane of the parabolic reflector which would normally not be intercepted is used rather than causing overheating of the light source housing. Furthermore as the divergence of the light source is reduced, a small diameter illumination patch is possible at the spatial light modulators, thus improving the efficiency of coupling of the light source output through the system to the projection screen.

It will be appreciated however, that whilst a light source in accordance with the invention has particular application in a projection system including tiltable mirror devices, the light source is equally applicable to the illumination of other forms of spatial light modulators such as liquid crystals. Equally the light source in accordance with the invention may find use on other forms of projection systems, or in other applications altogether.

It will be appreciated that it is particularly effective for the conic reflector 207 to be parabolic to produce the initial focusing of the output beam. However it is possible for the reflector to be elliptical although this will complicate the optical design.

I claim:

1. A light source comprising a sealed beam arc lamp including a first conic reflector, and an anode and a cathode which between them define an arc gap, the arc gap being positioned around the focal point of the first conic reflector such that light from the arc gap which is reflected from the first conic reflector is transmitted in a substantially parallel beam towards an output window of the arc lamp, and a second spherical reflector concentric with the focal point of the first conic reflector having an aperture effective to permit transmission of said parallel beam towards the output window arranged between the arc gap and the output window, the second spherical surface being arranged to reflect light back into the arc gap, and third and fourth opposed conic reflector light towards the center of the output beam in order to compensate for light obscured by one of said cathode and anode.

2. A light source according to claim 1, in which the first conic reflector is a parabolic reflector.

3. A light source according to claim 1, in which the first conic reflector does not extend past a focal plane of the conic reflector.

4. A light source according to claim 1, including at least one infra-red radiation reflective layer carried on the output window for the light source.

5. A light source according to claim 4, wherein inner and outer surfaces of said output window carry said reflective layers.

6. A light source according to claim 1, wherein the outer of said third and fourth opposed conic reflectors is integral with said second spherical reflector.

7. A light source according to claim 6, wherein the second spherical reflector and said outer conic reflector form part of the housing for the light source.

8. A projection system including the light source according to claim 1.

9. A light source according to claim 1, wherein the first conic reflector forms part of the housing for the light source.

* * * * *

UNITED STATES PATENT AND TRADEMARK OFFICE

CERTIFICATE OF CORRECTION

PATENT NO. : 5,869,920

DATED : February 9, 1999

INVENTOR(S) :. Kavanagh

It is certified that error appears in the above-identified patent and that said Letters Patent is hereby corrected as shown below:

On the Title page, item [73] Assignee should read –Digital Projection Limited, Manchester, Great Britain Signed and Sealed this Twenty-third Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,869,920

DATED : February 9, 1999

INVENTOR(S) : Martin Kavanagh

It is certified that error appears in the above-identified patent and that said Letters Patent is hereby corrected as shown below:

Title page, item [73], Assignee's address delete "London" and insert --Manchester, England--.

Column 6, line 4, delete "reflector light towards the center of the output beam" and insert --reflectors effective to reflect light towards the center of the output beam--.

Signed and Sealed this

Twenty-fourth Day of October, 2000

*Attest:*

Q. TODD DICKINSON

*Attesting Officer*

*Director of Patents and Trademarks*